United States Patent [19]

Tury et al.

[11] Patent Number: 4,760,197

[45] Date of Patent: Jul. 26, 1988

[54] CORROSION INHIBITION

[75] Inventors: Bernard Tury, Prestwich; Glyn R. John, Warrington; Edward G. Scovell, Rochdale, all of England

[73] Assignee: Imperial Chemical Industries PLC, London, England

[21] Appl. No.: 98,726

[22] Filed: Sep. 15, 1987

Related U.S. Application Data

[63] Continuation of Ser. No. 25,078, Mar. 12, 1987, abandoned.

[30] Foreign Application Priority Data

Mar. 12, 1986 [GB] United Kingdom ..... 8606065

[51] Int. Cl.[4] ..... C07C 39/08

[52] U.S. Cl. ..... 568/766; 252/387; 106/14.05

[58] Field of Search ..... 568/776; 252/387; 106/14.05

[56] References Cited

U.S. PATENT DOCUMENTS 2,429,905 10/1947 Wright ..... 252/387

FOREIGN PATENT DOCUMENTS 676632 7/1952 United Kingdom ..... 106/14.05
1034576 6/1966 United Kingdom ..... 252/387
1045118 10/1966 United Kingdom ..... 568/766

OTHER PUBLICATIONS

Katayama Chemical Works, "Chemical Abstracts", vol. 99, p162443t (1983).

*Primary Examiner*—Werren B. Lone
*Attorney, Agent, or Firm*—Cushman, Darby & Cushman

[57] ABSTRACT

A process which comprises contacting the surface of a metal with an alkyl or acyl substituted catechol.

The contacting may be effected using the substituted catechol alone or in a suitable medium for example as a solution or emulsion. The contacting is effective in providing corrosion inhibition even with lightly rusted iron surfaces.

11 Claims, No Drawings

CORROSION INHIBITION

This is a continuation of application Ser. No. 025,078, filed Mar. 12, 1987 which was abandoned upon the filing thereof.

This invention relates to a process for the inhibition of corrosion of metals.

Various corrosion inhibitors are known, the majority of which are of the reservoir type and are included as additives to water, solvent, oil-based systems or greases used in contact with a metal. Thus such inhibitors are included for example in boiler waters where they are continuously contacted with the surface to be treated. Corrosion inhibitors which are applied to a metal surface and form a protective coating which does not need to be continuously replenished are also known, and zinc phosphate and chromate treatments are conventionally used for this purpose. However, such treatments provide only limited protection and may have adverse environmental implications.

According to the present invention there is provided a process which comprises contacting the surface of a metal with a substituted hydroxybenzene of the type

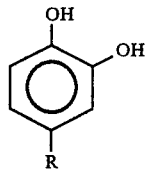

wherein: R is an alkyl, alkenyl or acyl group containing 7 to 30 carbon atoms.

Especially useful substituted hydroxybenzenes have the structures

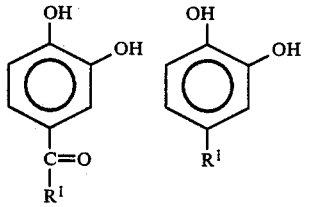

wherein:

$R^1$ is an alkyl group containing 7 to 22 carbon atoms.

The substituent may be linear or branched, saturated or unsaturated. Branched alkyl groups are especially preferred. The process of the invention provides an increased resistance to corrosion and is especially suitable for the corrosion inhibition of iron, zinc, copper, tin and aluminium, particularly mild steel and the zinc surface of galvanised steel.

The contacting with the substituted hydroxybenzene may be effected by applying the substituted hydroxybenzene alone to the surface of the metal. However, it is generally preferred that contacting is effected by applying the substituted hydroxybenzene in a suitable medium to the metal surface. More specifically, the substituted hydroxybenzene can be applied to the metal surface in the form of a solution in a suitable organic solvent, or as an aqueous emulsion of the substituted hydroxybenzene, or as an aqueous emulsion of a solution of the substituted hydroxybenzene in a suitable organic solvent. The substituted hydroxybenzene may be used to provide a protective coating in its own right, or the contacting may be effected as a metal pre-treatment before the application of a surface coating. Alternatively, the substituted hydroxybenzene may be incorporated into a surface coating composition, or may be employed as an additive to petroleum refined products such as lubricating oils, turbine oils, fuel oils and gasohols and greases.

Conventional organic solvents may be used for the substituted hydroxybenzene and include for example alcohols, ethers, ketones and aliphatic and aromatic hydrocarbons. Especially preferred solvents are those having good wetting and drying properties and include for example toluene, xylene, chloroform, 1,1,1-trichloroethane, and octanol.

Aqueous emulsions of the substituted hydroxybenzene may be formed in conventional manner using conventional dispersants and surfactants, including nonionic dispersants. It may be convenient to contact the metal surface with an aqueous emulsion of the substituted hydroxybenzene.

The process of the present invention may provide corrosion inhibition either without the application of a further surface coating or as a pre-treatment before the application of a further surface coating. Thus the contacting may be used for example to provide temporary protection whilst the metal is being transferred from one site to another. Hence the process of the present invention may be used for the temporary protection of a metal surface and the protective coating subsequently dissolved before or during further processing.

Alternatively, the substituted hydroxybenzene may be formulated in a surface coating composition, for example a paint (primer) such as an air-drying, oil-modified system or a system including a chlorinated rubber; a lacquer; a resin or other protective coating. The surface coating may be a solvent-based composition, for example a cellulose/solvent based primer paint such as those used for car "touch up" paints. The substituted hydroxybenzene is soluble in solvents generally used for such primers (for example nitrocellulose) and may be incorporated directly. The substituted hydroxybenzene may also be used as an emulsion in aqueous emulsion surface coating systems, for example primers or protective coatings based on polymer lattices such as for example acrylic and styrene/acrylic lattices and vinyl acrylic co-polymer lattices including acrylate modified vinyl chloride - vinylidene chloride copolymer lattices. The substituted hydroxybenzene may also for example be incorporatad in temporary alkali-removable protective coatings (whether solvent-based or emulsion based) of the addition polymer type in which the polymer contains carboxyl groups.

The substituted hydroxybenzenes, or the solution or emulsion thereof, may be applied to the metal in conventional manner, for example by dipping, spraying or brushing. The temperature of the application may be from 0 to 50° C. Typically, solutions of the substituted hydroxybenzene may contain from 0.1 to 20% by weight of substituted hydroxybenzene, whilst emulsions preferably contain from 0.1 to 5% by weight of the substituted hydroxybenzene. The presence of from 0.1 to 2% by weight of the substituted hydroxybenzene in a surface coating emulsion formulation is generally sufficient to provide improved corrosion inhibition.

The metal surface which is contacted with the substituted hydroxybenzene may be brightly polished and/or freshly cleaned, but it is an advantageous feature of the process of the present invention that effective corrosion inhibition may be obtained even on a lightly rusted surface. Indeed we have found that better results are in general achieved by contacting the substituted hydroxybenzene with a surface, in an "as received" condition, than by contacting with the same surface which is freshly cleaned or brightly polished.

The process of the present invention may be combined with conventional corrosion inhibition treatments such as the phosphating of iron.

As indicated above, the process of the present invention is equally effective on lightly rusted iron surfaces, and may be used in this context as a "rust converter". We have found that the substituted hydroxybenzene, when formulated in suitable surface coating systems, especially vinyl acrylic copolymer lattices, provides improved protection when compared with conventional "rust converter" products (generally tannic acid-latex based).

The substituted hydroxybenzene compounds of the present invention are obtained using general procedures well known to the man skilled in the art. For example U.S. Pat. No. 3327024 describes the preparation of 4-dodecylcatechol (branched isomers) from propylene tetramer, using boron trifluoride as catalyst.

The invention is illustrated by the following non-limitative examples in which all parts and percentages are by weight unless otherwise stated.

EXAMPLE 1

Bright mild steel 1 inch×1 inch coupons were thoroughly washed with acetone followed by ethanol and stored in kerosene until required. Immediately prior to use they were washed in acetone. A test coupon prepared as above was immersed in a 5% wt/wt solution of 4-dodecylcatechol (branched isomers) in industrial methylated spirit and then transferred to distilled water. A control coupon, prepared in the same way, but not treated with the substituted catechol solution or industrial methylated spirit, was similarly immersed in distilled water. After 13 days the test coupon has developed a blue colouration with little sign of corrosion. A weight loss of 0.01% was recorded. In contrast the control coupon appeared heavily corroded and weight loss was recorded as 0.5%.

EXAMPLE 2

The procedure of Example 1 was repeated except that the test coupon was immersed in a 10% wt/wt solution of 4-dodecylcatechol (branched isomers) in 1,1,1-trichloroethane and then transferred to a 3% wt/wt aqueous salt solution. After 5 days the test coupon had developed a blue-brown colouration and after washing and drying a weight loss of 0.09% was recorded. In contrast the control coupon, which had not been coated with the catechol, appeared heavily corroded and weight loss was recorded as 0.18%.

EXAMPLE 3

4-Octadecylcatechol was added at a concentration of 5% by weight to a solution of acrylic polymer in industrial methylated spirits. The solution of acrylic polymer contained 18% by weight of non-volatile material, as determined by evaporation to dryness. After thoroughly mixing, clean bright mild steel coupons, prepared as in Example 1, were immersed in the polymer mix, removed and allowed to dry and harden for several hours.

The test coupons were then fully immersed in 3% wt/wt aqueous salt solution. After 5 days the coupons were removed and cleaned to reveal a bright shiny surface similar in appearance to the original coupons. Modest corrosion was observed and the weight loss was 0.04%. In contrast, coupons which had been treated with a polymer solution not containing 4-octadecylcatechol were heavily rusted and a weight loss of 0.14% was recorded.

EXAMPLE 4

The procedure of Example 3 was repeated except that 4-octadecanoylcatechol was used as the corrosion inhibitor. The test coupon and control coupon were immersed in a 3% wt/wt aqueous salt solution for 5 days after which the test coupon showed only modest corrosion and the weight loss was 0.03%. The control coupon treated with a polymer solution not containing 4-octadecanoylcatechol was heavily corroded and a weight loss of 0.13% was recorded.

EXAMPLE 5

The procedure of Example 3 was repeated except that 4-tetradecylcatechol was used as the corrosion inhibitor. After immersion in the polymer mix, removal and drying, a coating weight of 7.9 $g.m^{-2}$ was recorded. The test coupon was then immersed in distilled water. After 77 days the coupon had developed a blue-grey colouration and was removed and cleaned. A weight loss of 0.04% was recorded. In contrast a coupon treated with a polymer solution not containing 4-tetradecylcatechol, having a coating weight of 6.5 $g.m^{-2}$, was heavily corroded and the weight loss was recorded as 0.08%.

EXAMPLE 6

4-Hexadecylcatechol was added at a concentration of 2.5% wt/wt to a 2.5% wt/wt solution of 4-nonylphenol (an "inert film former") in 1,1,1-trichloroethane. After thoroughly mixing, a bright mild steel coupon, prepared as in Example 1, was immersed in the test solution and then transferred to a 3% wt/wt aqueous salt solution. After 5 days the coupon was removed and cleaned. A weight loss of 0.08% was recorded. In contrast, a control coupon, obtained by immersing a clean coupon in a 5% wt/wt solution of 4-nonylphenol in 1,1,1-trichloroethane was heavily corroded and weight loss was recorded as 0.17%.

EXAMPLE 7

An emulsion containing 4-dodecylcatechol (branched isomers) at a concentration of 2% wt/wt and an acrylic polymer solution, as used in Example 3, was prepared by conventional means. The white emulsion was applied by brushing to the surface of a lightly rusted mild steel panel. The treated area rapidly darkened and within minutes a hard black surface coating had formed which exhibited good corrosion protection in standard accelerated test environments. For example, upon subjecting the panel to salt spray testing (ASTM specifications, B117-73) little blistering or rust break through was evident after 188 hours exposure. Further, upon overpainting a similarly prepared panel with a commercial topcoat (gloss) paint, no staining or bleeding through of the rust converter agent (i.e. 4-dodecylcatechol) or the resulting rust conversion products were noted. In contrast, a conventional rust converter (tannic acid latex type) similarly assessed, exhibited strong darkening and rust conversion properties but did not afford similar protection in the salt spray test environment. Further, on overpainting a lightly rusted mild steel panel previously treated with the conventional rust converter, substantial staining and bleeding characteristics were noted within hours.

EXAMPLE 8

To a grease (universal type lithium 12-hydroxystearate based on 500 Pale Oil and containing no additives) were added various substituted hydroxybenzenes, each in an amount to provide a concentration of 5% wt/wt. A sample of each grease containing a substituted hydroxybenzene was subjected to the Institute of Petroleum dynamic anti-rust test for lubricating greases (IP 220/81) using a 3% wt/wt sodium chloride solution in de-ionised water. A sample of grease containing no added substituted hydroxybenzene was used as a control.

After completion of the test and following careful inspection of the surface of the outer race, each was given a rating in accordance with the specifications laid down in the test. The test results are set out in the following Table.

TABLE

| Additive (a) | Rating (b) |
|---|---|
| DDC | 0–1 |
| HDC | 1–2 |
| NIL | 5 |

Note to Table
(a) DDC is 4-dodecylcatechol
HDC is 4-hexadecylcatechol.
(b) The ratings are determined as follows:
0 - No corrosion
1 - No more than 3 rust spots visible to naked eye
2 - Small corroded areas covering less than 1% of running track surface
3 - Corroded areas covering 1–5% of running track surface
4 - Corroded areas covering 5–10% of running track surface
5 - Corroded areas covering more than 10% of running track surface.

EXAMPLE 9

The procedure of Example 3 was repeated except that 4-hexadecanoylcatechol was used as the corrosion inhibitor. At the completion of the test, the test coupon showed a weight loss of 0.05% whereas the control coupon showed a weight loss of 0.13%.

We claim:

1. A process which comprises contacting the surface of a metal with a substituted hydroxybenzene of formula

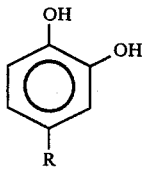

wherein:

R is an acyl group containing 7 to 30 carbon atoms.

2. The process of claim 1 wherein the substituted hydroxybenzene has the structure

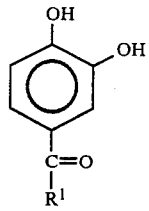

wherein:

$R^1$ is an alkyl group containing 7 to 22 carbon atoms.

3. The process of claim 1 wherein the substituted hydroxybenzene is 4-octadecanoylcatechol or 4-hexadecanoylcatechol.

4. The process of claim 1 wherein the substituted hydroxybenzene is applied to the metal surface as a solution in an organic solvent, as an aqueous emulsion of the substituted hydroxybenzene or as an aqueous emulsion of a solution of the substituted hydroxybenzene.

5. A process as claimed in claim 4 wherein the substituted hydroxybenzene is incorporated into a surface coating composition.

6. The process of claim 5 wherein the surface coating composition is a paint, lacquer or a resin.

7. The process of claim 6 wherein contacting is effected at a temperature of from 0 to 50° C.

8. The process of claims 7 wherein the metal is iron, zinc, copper, tin or aluminium.

9. The process of claim 8 wherein the metal surface is a lightly rusted iron surface.

10. A surface coating composition comprising a substituted hydroxybenzene of the formula

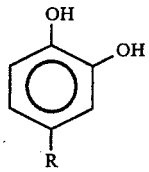

wherein:

R is an acyl group containing 7 to 30 carbon atoms.

11. A metal having on at least one surface thereof a coating which is, or which contains, a substituted hydroxybenzene of the formula

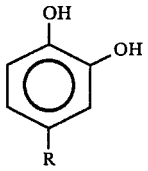

wherein:

R is an acyl group containing from 7 to 30 carbon atoms.

* * * * *